US011788533B2

(12) United States Patent
Widmer et al.

(10) Patent No.: US 11,788,533 B2
(45) Date of Patent: Oct. 17, 2023

(54) MULTISTAGE CENTRIFUGAL PUMP

(71) Applicant: Sulzer Management AG, Winterthur (CH)

(72) Inventors: Marc Widmer, Winterthur (CH); Daniele Cimmino, Figino (CH)

(73) Assignee: SULZER MANAGEMENT AG, Winterthur (CH)

( * ) Notice: Subject to any disclaimer, the term of this patent is extended or adjusted under 35 U.S.C. 154(b) by 0 days.

(21) Appl. No.: 17/853,295

(22) Filed: Jun. 29, 2022

(65) Prior Publication Data

US 2023/0011820 A1 Jan. 12, 2023

(30) Foreign Application Priority Data

Jul. 6, 2021 (EP) ..... 21184022

(51) Int. Cl.
*F04D 1/10* (2006.01)
*F04D 1/06* (2006.01)
(Continued)

(52) U.S. Cl.
CPC ..... *F04D 1/10* (2013.01); *F04D 1/06* (2013.01); *F04D 15/0005* (2013.01);
(Continued)

(58) Field of Classification Search
CPC ..... F04D 1/06; F04D 1/10; F04D 15/0005; F04D 27/0215; F04D 27/023; F04D 27/0238; F04D 29/2222
See application file for complete search history.

(56) References Cited

U.S. PATENT DOCUMENTS 2,450,137 A 9/1948 Harlamoff
2,656,096 A 10/1953 Schwarz
(Continued)

FOREIGN PATENT DOCUMENTS

GB 737172 A * 9/1955 ..... F04D 27/009
JP S51112204 U 9/1976
WO 2009095097 A1 8/2009

OTHER PUBLICATIONS

Sulzer, HPT High Pressure Barrel Casing Pump, archived as early as Sep. 26, 2020 (Year: 2020).*
(Continued)

*Primary Examiner* — Audrey B. Walter
(74) *Attorney, Agent, or Firm* — GLOBAL IP COUNSELORS, LLP

(57) ABSTRACT

A multistage centrifugal pump for conveying a fluid includes a pump housing with an inlet to receive the fluid and an outlet to discharge the fluid, a first stage impeller and a last stage impeller to convey the fluid from the inlet to the outlet, a shaft to rotate the first stage impeller and the last stage impeller about an axial direction, a suction chamber arranged upstream of the first stage impeller and in fluid communication with the inlet, a recirculation path for the fluid including a return opening and extending from the return opening to the suction chamber, the return opening located at or in the flow path downstream of the first stage impeller and upstream of the last stage impeller, and a flow control rod disposed in the recirculation path, the flow control rod to adjust a recirculation flow through the recirculation path into the suction chamber.

14 Claims, 4 Drawing Sheets

(51) Int. Cl.
*F04D 15/00* (2006.01)
*F04D 27/02* (2006.01)
*F04D 29/22* (2006.01)

(52) U.S. Cl.
CPC ..... *F04D 27/023* (2013.01); *F04D 27/0215* (2013.01); *F04D 27/0238* (2013.01); *F04D 29/2222* (2013.01)

(56) References Cited

U.S. PATENT DOCUMENTS

| | | | | |
|---|---|---|---|---|
| 11,255,338 | B2 * | 2/2022 | Brun | F04D 27/0246 |
| 2016/0327050 | A1 * | 11/2016 | Nakaniwa | F04D 29/682 |
| 2020/0088201 | A1 | 3/2020 | Bourne | |

OTHER PUBLICATIONS

European Search Report dated Dec. 1, 2021 in corresponding European Application No. 21184022.8.

* cited by examiner

MULTISTAGE CENTRIFUGAL PUMP

CROSS-REFERENCE TO RELATED APPLICATION

This application claims priority to European Patent Application No. 21184022.8 filed Jul. 6, 2021, the contents of which are hereby incorporated by reference in their entirety.

BACKGROUND

Field of the Invention

The present disclosure relates to a multistage centrifugal pump for conveying a fluid.

Background Information

Conventional centrifugal pumps for conveying a fluid, for example a liquid such as water, are used in many different industries. Examples are the oil and gas industry, the power generation industry, the chemical industry, the water industry or the pulp and paper industry. For many applications centrifugal pumps are configured as a multistage pump having a plurality of impellers, i.e. at least a first stage impeller and a last stage impeller and optionally one or more intermediate stage impeller(s). All impellers are arranged one after another on a shaft provided for rotating the impellers. In many cases a volute or a diffuser is arranged downstream of each impeller for redirecting the fluid to the suction area of the impeller of the next stage or downstream of the last stage impeller for guiding the fluid to the outlet. The impellers can be configured for example as a radial impeller or as an axial or semi-axial impeller or as a helicoaxial impeller. Furthermore, the impeller can be configured as an open impeller or as a closed impeller, where a shroud is provided on the impeller, said shroud at least partially covering the vanes of the impeller.

SUMMARY

In a multistage pump the impellers mounted one after another on the shaft can be arranged in an inline arrangement or in a back-to-back arrangement.

The performance curve or pump curve of a centrifugal pump for a particular speed is usually given by the H-Q-curve showing the relationship between the head H generated by the pump and the flow Q generated by the pump. The head H is also referred to as the delivery head, which is the discharge pressure at the outlet of the pump. In most applications the centrifugal pump is operated at or very close to the best efficiency point, which is the point on the H-Q-curve, where the hydraulic efficiency of the pump is at maximum.

Classically, the discharge flow of a centrifugal pump for a given head H is defined and adjusted by the geometry of the hydraulic unit, such as the geometry of the impellers and/or the geometry of the diffuser, e.g. the diffuser throat (s), or the geometry of the volute(s). Thus, for generating a given discharge flow for a desired delivery head the geometry of the hydraulic unit comprising the impellers and the diffusers is specifically adapted and adjusted. Therefore, it has been determined that changes in the desired discharge flow typically require an adaption of the geometry of the hydraulic unit of the pump.

In particular for centrifugal pumps operating at low specific speeds, it is typically difficult to exactly meet the required delivery head and discharge flow with classical methods such as impeller trimming. Due to manufacturing tolerances for example at the diffuser throat area or with respect to the labyrinth diameters, the mass flow passing through the centrifugal pump can vary considerably, influencing the main mass flow critically.

This issue is addressed by the present disclosure.

It is therefore an object of the present disclosure to propose a multistage centrifugal pump for conveying a fluid, which enables easy modification of the discharge flow for a given delivery head. The multistage pump enables easy tuning of the mass flow discharged by the pump according to the needs of a specific application without substantially impacting the delivery head of the pump.

The subject matter of exemplary embodiments of the invention satisfying these objects is characterized by the features of the present disclosure.

Thus, according to an embodiment of the invention, a multistage centrifugal pump for conveying a fluid is proposed, comprising a pump housing with an inlet for receiving the fluid and an outlet for discharging the fluid, at least a first stage impeller and a last stage impeller for conveying the fluid from the inlet along a flow path to the outlet, a shaft for rotating each impeller about an axial direction, and a suction chamber, which is arranged upstream of the first stage impeller and in fluid communication with the inlet. A recirculation path for the fluid is provided comprising at least one return opening and extending from the return opening to the suction chamber, wherein the return opening is located at or in the flow path downstream of the first stage impeller and upstream of the last stage impeller, wherein a flow control rod is disposed in the recirculation path, and wherein the flow control rod is configured for adjusting a recirculation flow through the recirculation path into the suction chamber.

Accordingly, the discharge flow, i.e. the mass flow of the fluid discharged at the outlet of the centrifugal pump, is adjusted to a desired value by internally recirculating a recirculation flow, i.e. a secondary mass flow of the fluid, from a location downstream of the first stage impeller to the suction chamber of the centrifugal pump. The adjustment of the recirculation flow is performed by the flow control rod, which is configured to modify the recirculation flow. By increasing the recirculation flow the discharge flow can be decreased such that the discharge flow is adjusted to the desired value. By adjusting the recirculation flow it is for example possible to compensate manufacturing tolerances resulting in a discharge flow, which is too high. Thus, the hydraulic unit comprising the impellers and e.g. diffusors of the centrifugal pump can be configured in such a manner that at the delivery head (desired discharge pressure) the discharge flow without any recirculation flow is in no case smaller that the desired discharge flow at the given delivery head. If the discharge flow is larger than the desired discharge flow, the internal recirculation flow is increased to reduce the discharge flow. The recirculation flow is adjusted to a value such that the actual discharge flow corresponds to the desired discharge flow at the given delivery head.

In addition, adjusting the internal recirculation flow to reduce the discharge flow passing through the outlet of the pump has the considerable advantage that a universal hydraulic unit can be used for generating different discharge flows. If a second centrifugal pump is required, which shall generate a different discharge flow with preferably the same head than a first centrifugal pump, it is no longer necessary to modify the geometry of the hydraulic unit (e.g. impellers and/or diffusers) of the second centrifugal pump, i.e. for the second centrifugal pump the same hydraulic unit can be used as for the first centrifugal pump. Rather than modifying the hydraulic flow generated by the hydraulic unit to change the discharge flow, the recirculation flow is modified to change the discharge flow.

Since the universal hydraulic unit can be used to produce different discharge flows, it is possible to realize various pump curves (H-Q-curves) with the same hydraulic unit, e.g. with the same set of impellers and diffusers.

The tuning of the discharge flow by modifying the recirculation flow is in particular advantageous for applications requiring a low discharge flow and a high delivery head (discharge pressures). In such applications the sensitivity of the discharge flow both on the geometry of the hydraulic unit and on the recirculation flow is very high. By modifying the recirculation flow, i.e. only one parameter, it is possible to adjust the discharge flow to the desired value.

According to a preferred embodiment the multistage centrifugal pump comprises a second stage impeller, wherein each return opening is located at or in the flow path downstream of the first stage impeller and upstream of the second stage impeller. Thus, the recirculation flow is preferably branched off at a location between the first stage impeller and the second stage impeller. This measure is in particular advantageous in view of the efficiency of the centrifugal pump, because the fluid which is recirculated to the suction chamber is only pressurized by one stage, namely the first stage of the centrifugal pump.

In applications where the multistage centrifugal pump is configured as a two stage pump the second stage impeller also constitutes the last stage impeller.

According to a particularly preferred embodiment, the flow control rod is configured and arranged to be removable from and insertable into the recirculation path from the outside of the centrifugal pump. Thus, for adjusting the recirculation flow it is not necessary to disassemble the centrifugal pump. Only the flow control rod is pulled out of the pump and modified—as it will be explained in more detail hereinafter—to increase the internal recirculation flow. After the modification the flow control rod is simply inserted into the recirculation path and fixed, for example to the housing of the centrifugal pump.

It is a further advantageous measure that the recirculation path comprises a plurality of return openings, an annular intermediate chamber, and a return passage, wherein each return opening is in fluid communication with the intermediate chamber and wherein the return passage connects the intermediate chamber with the suction chamber. Thus, it becomes possible to simply place the flow control rod into the return passage of the recirculation path.

According to a preferred configuration the flow control rod extends from a first end to a second end and comprises a first internal chamber as well as a second internal chamber with the first and the second internal chamber delimited by an outer wall of the flow control rod, wherein the first internal chamber is located at the first end and open at the first end, wherein the second internal chamber is located at the second end and comprises at least one discharge opening for discharging fluid from the second internal chamber into the suction chamber, wherein the first internal chamber and the second internal chamber are separated from each other by a partition wall and wherein the flow control rod is configured such that the outer wall sealingly fits into the recirculation path at a location between the at least one return opening and the suction chamber.

Since the outer wall of the flow control rod sealingly engages with the recirculation path, the flow control rod blocks the recirculation path in such a manner that the fluid cannot pass around the flow control rod but only through the flow control rod, if there is a fluid connection between the first and the second internal chamber of the flow control rod.

Preferably, the flow control rod is placed into the return passage of the recirculation path. According to this design, the flow control rod is configured to sealingly fit into the return passage with the first end facing the intermediate chamber.

Furthermore, it is preferred that in new condition of the flow control rod the partition wall is closed for preventing a flow of the fluid from the first internal chamber to the second internal chamber, wherein the flow control rod closes the recirculation path, thus preventing the fluid from passing through the recirculation path into the suction chamber.

In new condition the flow control rod is plugging the recirculation path, for example between the intermediate chamber and the suction chamber. For improving the sealing action the outer wall of the flow control rod can comprise a sealing element such as a O-ring. In this condition, no fluid is passing through the recirculation path, i.e. the recirculation flow equals zero. The entire mass flow passing through the first stage impeller is passing though all stages of the centrifugal pump and leaving the centrifugal pump as discharge flow at elevated pressure at the outlet of the pump.

When the delivery head at the outlet of the centrifugal pump has the desired value, but the mass flow through the outlet is too high, the flow control rod can be pulled out of the centrifugal pump at standstill and a hole is provided, e.g. by drilling, in the partition wall to establish a flow connection between the first and the second internal chamber of the flow control rod. Thus, the partition wall includes a connection opening for allowing a flow of the fluid from the first internal chamber into the second internal chamber. Thus, the recirculation flow becomes different from zero. The fluid can pass from the intermediate chamber through the first and the second internal chamber of the flow control rod and through the at least one discharge opening into the suction chamber. By establishing the recirculation flow, the discharge flow is reduced and can be adjusted to the desired value.

Preferably the discharge opening is configured as a bore in the outer wall of the flow control rod extending from the second internal chamber through the outer wall of the flow control rod for allowing the fluid to flow from the second internal chamber to the suction chamber. The discharge opening and/or the connection opening can be configured as an orifice for throttling the recirculation flow. In particular, configuring both the connection opening and the discharge opening as a throttle has the advantage that the pressure prevailing at the return opening is reduced to the suction pressure prevailing in the suction chamber in two steps, whereby the pressure drop per throttle is reduced. This results in a considerable reduction of the risk that cavitation will occur along the recirculation path.

As a further preferred measure the discharge opening is configured to supply the fluid to the suction chamber with an entrance angle relative to a main flow direction of the fluid in the suction chamber, wherein the entrance angle is different from zero degree. Accordingly, it is preferred that the recirculation flow discharged as a kind of jet through the at least one discharge opening of the flow control rod, does not enter the suction chamber in a direction coinciding with the main flow direction of the fluid passing through the suction chamber. By this measure a negative impact of the recirculation flow on the suction performance of the centrifugal pump can be avoided. Furthermore, by optimizing the entrance angle of the recirculation flow, the suction performance can be improved.

From practice it becomes apparent, that the entrance angle is preferably between 45° and 315°.

Furthermore, it can be advantageous that the second internal chamber comprises a plurality of discharge openings, which are distributed along the circumference of the outer wall of the flow control rod, for example four discharge openings.

Regarding the configuration with the plurality of discharge openings it is preferred that the discharge openings are equidistantly distributed along the circumference of the outer wall of the flow control rod.

Preferably the multistage centrifugal pump is configured as a between-bearing pump.

In particular, the multistage centrifugal pump can be configured as a barrel type pump, comprising an outer barrel casing, in which the pump housing is arranged.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION

Figure 1:
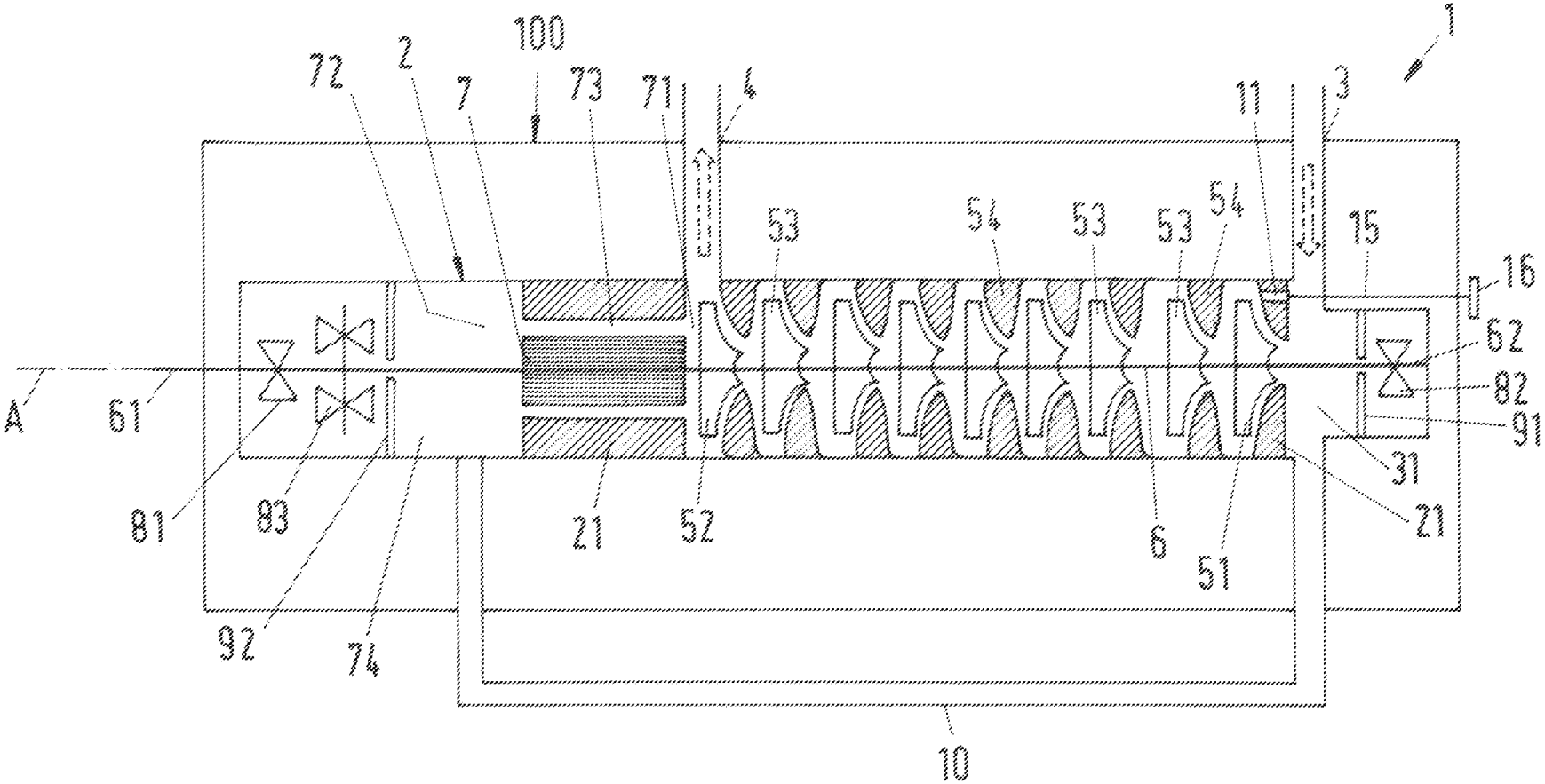
FIG. 1 is a schematic cross-sectional view of an embodiment of a multistage centrifugal pump according to the invention.

FIG. 1 shows a schematic cross-sectional view of an embodiment of a multistage centrifugal pump according to the invention, which is designated in its entity with reference numeral 1. The multistage centrifugal pump 1 is designed as a centrifugal pump for conveying a fluid, for example a liquid such as water.

The centrifugal pump 1 comprises a pump housing 2 having an inlet 3 and an outlet 4 for the fluid to be conveyed. The inlet 3 is arranged at a suction side, where a suction pressure prevails. The fluid is discharged at the outlet 4 with a delivery pressure, which is also referred to as discharge pressure. The suction pressure is also referred to as low pressure, and the delivery pressure is also referred to as high pressure. The supply of the fluid through the inlet 3 and the discharge of the fluid through the outlet 4 is indicated in FIG. 1 by the dashed arrows without reference numeral.

The centrifugal pump 1 further comprises a hydraulic unit with at least a first stage impeller 51 and a last stage impeller 52 for conveying the fluid from the inlet 3 along a flow path F (FIG. 2) to the outlet 4. Optionally, the centrifugal pump 1 comprises one or more intermediate stage impellers 53. In addition, the centrifugal pump 1 comprises a shaft 6 for rotating each impeller 51, 52, 53 about an axial direction A. The flow path F of the fluid through the pump 1 is indicated by the arrows with the reference numeral F.

The centrifugal pump 1 further comprises a suction chamber 31, which is in fluid communication with the inlet 3 and arranged upstream of the first stage impeller 51. The suction chamber 31 receives the fluid from the inlet 3 and guides the fluid into the axial direction A to the suction area of the first stage impeller 51. The suction chamber 31 is provided in a suction casing 21, which forms a part of the pump housing 2.

The axial direction A is defined by the axis of the shaft 6. Each impeller 51, 52, 53 is mounted to the shaft 6 in a torque proof manner. The shaft 6 has a drive end 61, which can be connected to a drive unit (not shown) for driving the rotation of the shaft 6 about the axial direction A. The drive unit can comprise, for example, an electric motor. The other end of the shaft 6 is referred to as non-drive end 62.

A direction perpendicular to the axial direction A is referred to as radial direction.

In the following description reference is made by way of example to an embodiment of the multistage centrifugal pump 1 having a plurality of impellers 51, 52, 53, namely the first stage impeller 51, the last stage impeller 52 and at least one intermediate stage impeller 53. All impellers 51, 52, 53 are arranged one after another on the shaft 6, wherein each intermediate stage impeller 53 is arranged between the first stage impeller 51 and the last stage impeller 52 when viewed along the flow path F. The last stage impeller 52 is the impeller closest to the outlet 4. The last stage impeller 52 pressurizes the fluid such that the fluid leaves the outlet 4 with the delivery pressure. The embodiment shown in FIG. 1 has nine stages, which has to be understood exemplary. Thus, the centrifugal pump 1 shown in FIG. 1 has seven intermediate stage impellers 53 arranged between the first stage impeller 51 and the last stage impeller 52. The plurality of impellers 51, 52, 53 can be arranged in an inline configuration as shown in FIG. 1 or in a back-to-back configuration.

Each impeller 51, 52, 53 is designed as a radial impeller. In particular, in the embodiment shown in FIG. 1 each impeller 51, 52, 53 is configured as a Barske impeller, which is an open impeller having a plurality of straight blades 55 (FIG. 2) extending in the radial direction. The hub of each impeller 51, 52, 53 includes a plurality of balancing holes 56 (FIG. 2) for reducing the axial thrust acting on the shaft 6.

The hydraulic unit further comprises a plurality of stationary diffusers 54, which are stationary with respect to the pump housing 2. Between each pair of adjacent impellers 51, 52, 53 a diffuser 54 is provided for redirecting the generally radial flow exiting from the particular impeller 51, 53 in a generally axial direction A towards the next stage impeller 53, 52. As an example, the fluid entering the suction chamber 31 is guided to the first stage impeller 51 by the suction casing 21. The first stage impeller 51 is increasing the pressure of the fluid and providing a mass flow of the fluid to the diffuser 54, which is the first diffuser 54 along the flow path F. At this diffuser 54, the mass flow of the fluid is throttled by the throat area of this diffuser 54 and kinetic energy of the fluid is partially transformed into additional pressure. Then the flow is guided through return channels towards the inlet of the next stage impeller 53 (which is the first intermediate stage impeller 53) for further increasing the pressure of the fluid.

The hydraulic unit comprises the entirety of all impellers 51, 52, 53 and all diffusers 54.

The multistage centrifugal pump 1 shown in FIG. 1 is designed as a horizontal pump, meaning that during operation the shaft 6 is extending horizontally, i.e. the axial direction A is perpendicular to the direction of gravity. In particular, the centrifugal pump 1 shown in FIG. 1 can be designed as a horizontal barrel casing multistage pump 1, i.e. as a double-casing pump. The multistage pump 1 can be designed, for example, as a pump 1 of the pump type BB5 according to API 610. When configured as a BB5 type pump, the centrifugal pump 1 comprises an outer barrel casing 100, in which the pump housing 2 is arranged. In the described embodiment of the multistage centrifugal pump 1 the pump housing 2 comprises the suction casing 21, a plurality of stage casings 22 (FIG. 2), namely one stage casing 22 for each stage of the centrifugal pump 1, and a discharge casing (not shown) at the outlet 4 of the pump. The stage casings 22 are arranged one after another in the axial direction A, wherein all stage casings 22 are arranged between the suction casing 21 and the discharge casing. The discharge casing, all stage casings 22 and the suction casing 21 are arranged within the outer barrel casing 100 in a manner which is as such known in the art.

It has to be understood that the invention is not restricted to this type of centrifugal pump 1. In other embodiments, the centrifugal pump can be configured without an outer barrel casing, for example as a BB4 type pump, or as an axially split multistage pump, or as a vertical pump, meaning that during operation the shaft 6 is extending in the vertical direction, which is the direction of gravity, or as any other type of centrifugal pump.

The centrifugal pump 1 comprises bearings on both sides of the plurality of impellers 51, 52, 53 (with respect to the axial direction A), i.e. the centrifugal pump 1 is designed as a between-bearing pump. A first radial bearing 81, a second radial bearing 82 and an axial bearing 83 are provided for supporting the shaft 6. The first radial bearing 81 is arranged adjacent to the drive end 61 of the shaft 6. The second radial bearing 82 is arranged adjacent to or at the non-drive end 62 of the shaft 6. The axial bearing 83 is arranged between the plurality of impellers 51, 52, 53 and the first radial bearing 81 adjacent to the first radial bearing 81. The bearings 81, 82, 83 are configured to support the shaft 6 both in the axial direction A and in a radial direction, which is a direction perpendicular to the axial direction A. The radial bearings 81 and 82 are supporting the shaft 6 with respect to the radial direction, and the axial bearing 83 is supporting the shaft 6 with respect to the axial direction A.

In many configurations the bearings 81, 82, 83 are arranged in separate bearing housings, which are fixedly connected to the pump housing 2. However, since this matter is not important for the understanding of the invention, it will not be explained in more detail.

A radial bearing, such as the first or the second radial bearing 81 or 82 is also referred to as a "journal bearing" and an axial bearing, such as the axial bearing 83, is also referred to as an "thrust bearing". The first radial bearing 81 and the axial bearing 83 can be configured as separate bearings as shown in FIG. 1, but it is also possible that the first radial bearing 81 and the axial bearing 83 are configured as a single combined radial and axial bearing supporting the shaft both in radial and in axial direction.

The centrifugal pump 1 further comprises two sealing devices, namely a first sealing device 91 for sealing the shaft 6 at the suction side and a second sealing device 92 for sealing the shaft 6 at the discharge side. With respect to the axial direction A the first sealing device 91 is arranged between the first stage impeller 51 and the second radial bearing 82, and the second sealing device 92 is arranged between the last stage impeller 52 and the axial pump bearing 83. Both sealing devices 91, 92 seal the shaft 6 against a leakage of the fluid along the shaft 6 e.g. into the environment. Furthermore, by the sealing devices 91 and 92 the fluid can be prevented from entering the bearings 81, 82, 83. Preferably each sealing device 91, 92 comprises a mechanical seal. Mechanical seals are well-known in the art in many different embodiments and therefore require no detailed explanation. In principle, a mechanical seal is a seal for a rotating shaft 6 and comprises a rotor part fixed to the shaft 6 and rotating with the shaft 6, as well as a stationary stator part fixed with respect to the pump housing 2. During operation the rotor part and the stator part are sliding along each other—usually with a liquid as lubricant and coolant there between—for providing a sealing action to prevent the fluid from escaping to the environment or entering the bearings 81, 82, 83. In many embodiments a separate bearing isolator is provided which prevents liquids or solids to enter the bearings 81, 82, 83. In such embodiments where separate bearing isolators are provided, the sealing devices 91, 92, e.g. the mechanical seals prevent the fluid from leaking into the environment.

The centrifugal pump 1 further comprises a balance drum 7 for at least partially balancing the axial thrust that is generated by the impellers 51, 52, 53 during operation of the centrifugal pump 1. The balance drum 7 is fixedly connected to the shaft 6 in a torque proof manner. The balance drum 7 is arranged between the last stage impeller 52 and the second sealing device 92. The balance drum 7 defines a front side 71 and a back side 72. The front side 71 is the side facing the last stage impeller 52. The back side 72 is the side facing the second sealing device 92. The balance drum 7 is surrounded by a stationary part 21, so that a relief passage 73 is formed between the radially outer surface of the balance drum 7 and the stationary part 21. The stationary part 21 is configured to be stationary with respect to the pump housing 2. The relief passage 73 forms an annular gap between the outer surface of the balance drum 7 and the stationary part 21 and extends from the front side 71 to the back side 72. The front side 71 is in fluid communication with the outlet 4, so that the axial surface of the balance drum 7 facing the front side 71 is exposed essentially to the discharge pressure prevailing at the outlet 4 during operation of the pump 1. Of course, due to smaller pressure losses caused by the fluid communication between the outlet 4 and the balance drum 7 the pressure prevailing at the axial surface of the balance drum 7 facing the front side 71 can be somewhat smaller than the discharge pressure. However, the considerably larger pressure drop takes place over the balance drum 7. At the back side 72 a chamber 74 is provided, which is connected by a balance line 10 with the suction side, e.g. with the inlet 3. The pressure in the chamber 74 at the back side 72 is somewhat larger than the suction pressure due to the pressure drop over the balance line 10 but considerably smaller than the discharge or delivery pressure.

Since the front side 71 is exposed essentially to the discharge pressure at the outlet 4, a pressure drop exists over the balance drum 7 resulting in a force that is directed to the left side according to the representation in FIG. 1 and therewith counteracts the axial thrust generated by the impellers 51, 52, 53 during operation of the pump 1.

The balance line 10 is provided for recirculating the fluid from the chamber 74 at the back side 72 to the suction side of the centrifugal pump 1. A part of the pressurized fluid passes from the front side 71 through the relief passage 73 to the back side 72, enters the balance line 10 and is recirculated to the suction side of the centrifugal pump 1. The balance line 10 constitutes a flow connection between the back side 72 and the suction side at the pump inlet 3. The balance line 10 can be arranged—as shown in FIG. 1—outside the pump housing 2 and outside the barrel casing 100. In other embodiments the balance line 10 can be designed as internal line completely extending within the pump housing 2. In still other embodiments the balance line can be arranged outside the pump housing 2 and inside the barrel casing 100.

The multistage centrifugal pump 1 shall deliver a desired discharge flow at a given delivery head. The discharge flow is the mass flow of the fluid discharged at the outlet 4 and the delivery head is the head which is available at the outlet 4.

Since it is sometimes difficult, in particular for centrifugal pumps operating at low specific speeds, to match the hydraulic unit with the impellers 51, 52, 53 and the diffusers 54 of the centrifugal pump 1 to the desired discharge flow at the desired delivery head, for example due to machining tolerances or other manufacturing tolerances, it is proposed according to the invention to provide a recirculation path 11 inside the pump housing 2, so that a recirculation flow can be recirculated to the suction chamber 31 in order to adjust the discharge flow to the desired value without substantially changing the delivery head at the outlet of the pump 1.

This will now be explained in more detail referring in particular to FIG. 2, FIG. 3 and FIG. 4.

Figure 2:
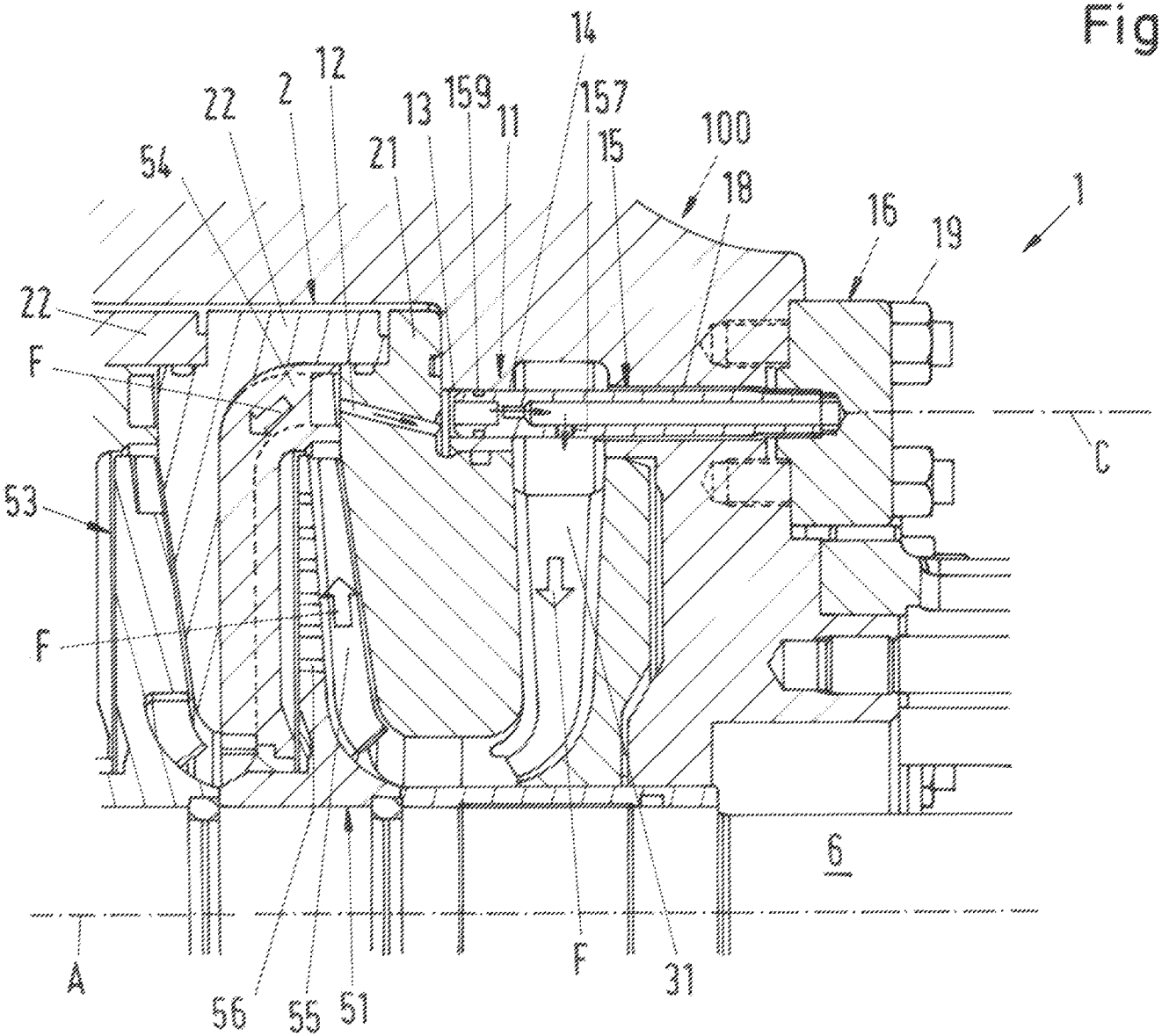
FIG. 2 is a cross-sectional view illustrating a configuration of the recirculation path.
Figure 3:
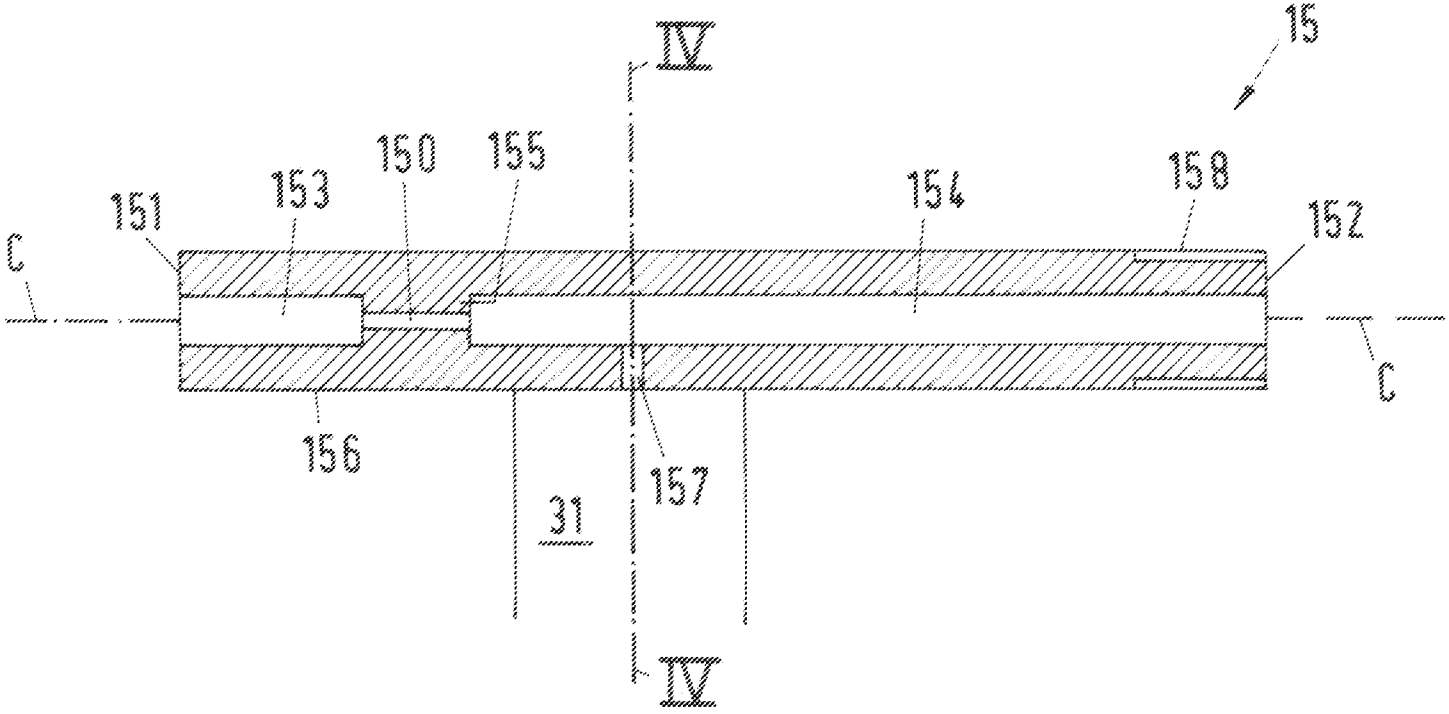
FIG. 3 is a schematic cross-sectional view of the flow control rod.

FIG. 2 shows a cross-sectional view illustrating a configuration of the internal recirculation path 11 for recirculating a mass flow of the fluid from a location downstream of the first stage impeller 51 to the suction chamber 31. FIG. 3 shows a more schematic view of a flow control rod 15 for adjusting the recirculation flow in a cross-sectional view along the longitudinal axis C of the flow control rod 15. For a better understanding FIG. 4 shows the flow control rod 15 of FIG. 3 in a cross-sectional view along the cutting line IV-IV in FIG. 3.

The recirculation path 11 is configured as an internal flow path, i.e. the recirculation path 11 does not comprise an external pipe attached to the pump housing 2 or to the outer barrel casing 100, respectively. The entire recirculation path 11 is arranged inside the pump housing 2 or inside the outer barrel casing 100.

The recirculation path 11 comprises at least one return opening 12 and extends from the return opening 12 to the suction chamber 31. The return opening 12 is located at or in the flow path F downstream of the first stage impeller 51 and upstream of the last stage impeller 52. Preferably, the return opening 12 is located between the first stage impeller 51 and the first one of the intermediate stage impellers 53, which is the second stage impeller 53, when viewed along the flow path F. As it can be best seen in FIG. 2 the fluid entering the suction chamber 31 is guided to the first stage impeller 51 by the suction casing 21. The first stage impeller 51 increases the pressure of the fluid and provides a mass flow of the fluid to the first one of the diffusers 54. At the diffuser 54, the mass flow of the fluid is throttled by the throat area of this diffuser 54 and kinetic energy of the fluid is recovered partially into additional pressure. After the diffuser 54 the main flow of the fluid is guided towards the suction area of the first intermediate stage impeller 53, which is the second stage impeller 53 (FIG. 2). A portion of the mass flow of the fluid is extracted through the return opening 12 located at the flow path F between the first stage impeller 51 and the first one of the diffusers 54 and enters the recirculation path 11.

Preferably, the recirculation path 11 comprises a plurality of return openings 12, which are distributed around the shaft 6 at a location between the first stage impeller 51 and the first of the diffusers 54. The recirculation path 11 further comprises an annular intermediate chamber 13 extending around the pump shaft 6. Each of the return openings 12 is in fluid communication with the intermediate chamber 13, so that the fluid forming the recirculation flow can enter the annular intermediate chamber 13 by passing through the return openings 12. Each return opening 12 is for example configured as a bore, which is drilled into the suction housing 21. The recirculation path 11 further comprises a return passage 14, connecting the annular intermediate chamber 13 with the suction chamber 31. The return passage 14 can be configured as a bore in the suction casing 21, extending from the annular intermediate chamber 13 to the suction chamber 31.

The flow control rod 15 extends from a first end 151 to a second end 152 and comprises a first internal chamber 153 as well as a second internal chamber 154, which are separated from each other by a partition wall 155. The first internal chamber 153 and the second internal chamber 154 are arranged one after another with respect to the longitudinal axis C of the flow control rod 15 and both chambers 153 and 154 are delimited by an outer wall 156 of the flow control rod 15. The first internal chamber 153 is arranged at the first end 151 of the flow control rod 15 and open at the first end 151. The second internal chamber 154 is arranged at the second end 152 of the flow control rod 15 and open at the second end 152. Furthermore, the second internal chamber 154 comprises at least one discharge opening 157 for discharging the fluid from the second internal chamber 154 into the suction chamber 31. The discharge opening 157 is configured as a bore passing through the outer wall 156 of the flow control rod 15, and located such, that the discharge opening 157 constitutes a flow connection between the second internal chamber 154 and the suction chamber 31, when the flow control rod 15 is inserted into the recirculation path 11.

The first internal chamber 153 is configured as a blind bore, which is drilled from the first end 151 of the flow control rod 15 in direction of the longitudinal axis C into the flow control rod 15. The second internal chamber 154 is configured as a blind bore, which is drilled from the second end 152 of the flow control rod 15 in direction of the longitudinal axis C into the flow control rod 15. The blind bores forming the first internal chamber 153 and the second internal chamber 154 are drilled into the flow control rod 15 to such a depth that there remains the partition wall 155 separating the two internal chambers 153 and 154.

The outer wall 156 of the flow control rod 15 includes a thread 158 at the second end 152, so that the second end 152 of the flow control rod 15 can be screwed into a mounting piece 16 (FIG. 2) for fixedly connecting the flow control rod 15 to the mounting piece 16.

The flow control rod 15 is configured such that the outer wall 156 sealingly fits into the return passage 14 with the first end 151 facing the annular intermediate chamber 13. A sealing element 159 (FIG. 2) such as a O-ring can be disposed in or at the outer wall 156 for sealing between the outer wall 156 of the flow control rod 15 and the inner wall delimiting the return passage 14 of the recirculation path 11. Thus, when the flow control rod 15 is inserted into the return passage 14 the fluid is prevented from flowing between the outer wall 156 of the flow control rod 15 and the inner wall delimiting the return passage 14. The fluid can only pass through the flow control rod 15, but not around the flow control rod 15.

Furthermore, when the flow control rod 15 is located in the return passage 14 of the recirculation path 11, the discharge opening 157 is located such that it opens into the suction chamber 31.

Particularly preferred, the flow control rod 15 is configured and arranged to be removable from and insertable into the recirculation path 11 from the outside of the centrifugal pump 1. As it can be best seen in FIG. 2, the outer barrel casing 100 or a cover of the outer barrel casing 100 includes a bore 18 extending from the outside of the outer barrel casing 100 to the suction chamber 31. The flow control rod 15 is screwed into the mounting piece 16. Then, the first end 151 of the flow control rod 15 is inserted into the bore 18 and the flow control rod 15 is pushed into the bore 18 until the flow control rod 15 sealingly engages with the return passage 14 of the recirculation path 11. Then, the mounting piece 16 is fixed to the outer barrel casing 100, for example by a plurality of screws or bolts 19. Thus, the flow control rod 15 is easily insertable into and removable from the recirculation path 11 from the outside of the centrifugal pump 1. Furthermore, a sealing such as a gasket can be provided between the mounting piece 16 and the outer barrel casing 100 for preventing a leakage of the fluid to the environment. The mounting piece 16 can be configured as a blind flange with a gasket.

Preferably, in new condition of the flow control rod 15 the partition wall 155 separating the first internal chamber 153 from the second internal chamber 154 is completely closed for preventing a flow of the fluid from the first internal chamber 153 to the second internal chamber 154. Thus, when the flow control rod 15 is placed into the return passage 14 and fixed to the pump 1 by the bolts 19, the flow control rod 15 completely closes the recirculation path 11, thus preventing that any fluid can pass through the recirculation path 11 into the suction chamber 31. The recirculation flow is zero.

The hydraulic unit with the impellers 51, 52, 53 and the diffusers 54 is configured such that the discharge flow at the delivery head is at least as large as the desired discharge flow, meaning that the hydraulic unit is configured such, that the discharge flow at the delivery head is in no case smaller than the desired discharge flow.

When operating or testing the pump, it is determined at the delivery head, whether the discharge flow corresponds to the desired flow or whether the discharge flow is larger than the desired discharge flow. If the discharge flow corresponds to the desired discharge flow, no further action or further measures are required and the centrifugal pump 1 can be operated.

If the detected discharge flow at the delivery head is too high, the flow control rod 15 is pulled out of the centrifugal pump 1 at standstill and the partition wall 155 between the first internal chamber 153 and the second internal chamber 154 includes a connection opening 150, for example by drilling a bore through the partition wall 155, preferably centrally in the partition wall 155, to allow a flow of the fluid from the first internal chamber 153 into the second internal chamber 154, from where the fluid is discharged into the suction chamber 31 through the discharge opening 157. The diameter of the connection opening 150 is preferably smaller than the diameter of the first internal chamber 153 and smaller than the diameter of the second internal chamber 154, so that the connection opening 150 functions as a throttle. Furthermore, it is preferred, that the discharge opening 157 disposed in the outer wall 156 at the second internal chamber 154 is also configured as a throttle or as a orifice, respectively.

When the flow control rod 15 comprising the connection opening 150 is inserted into the recirculation path 11 and the centrifugal pump 1 is operated, the recirculation flow is no longer zero, but a secondary mass flow of the fluid is recirculated as recirculation flow from the return opening(s) 12 along the recirculation path 11 to the suction chamber 31. By the recirculation flow being different from zero the discharge flow passing through the outlet 4 of the centrifugal pump 1 is reduced and can be adjusted to the desired discharge flow, while the delivery head at the outlet is not changed or at least not substantially changed by the recirculation flow.

Adjusting the discharge flow to the desired discharge flow, i.e. the target value for the discharge flow, can require a multiple removal of the flow control pin 15 from the recirculation path 11. After the removal of the flow control pin 15 the connection opening 150 in the partition wall 155 and/or the discharge opening 157 are enlarged and the flow control rod 15 is reinserted into the recirculation path 11. After the flow control rod 15 has been fixed to the pump housing 2 or the outer barrel casing 100, respectively, the discharge flow at the outlet 4 is determined. If the discharge flow corresponds to the desired value (target value) the centrifugal pump 1 is ready for operation to deliver the desired discharge flow at the delivery head. If the discharge flow at the outlet 4 is still too large, the procedure of removing the flow control rod 15 and modifying the connection opening 150 and/or the discharge opening 157 is repeated as long as the discharge flow matches the desired discharge flow.

If by any reason the recirculation flow becomes too large, i.e. the discharge flow becomes too low and decreases below the desired value (target value), e.g. caused by wear or any other degradation, the flow control rod 15 can be replaced by a flow control rod 15 in new condition having no connection opening 150 in the partition wall 155. Thus, the recirculation flow is reset to zero. When the flow control rod 15 has been replaced by a new one, the discharge flow can be adjusted to the desired value in the same manner as described hereinbefore.

It is an additional advantage, that the connection opening 150 and the discharge opening 157 can be configured as two throttles which are arranged in series. The pressure difference between the pressure at the return opening(s) 12 and the suction chamber 31 is relieved over two main pressure drops, namely the pressure drop over the connection opening 150 and the pressure drop over the discharge opening 157. By distributing the pressure relief to the connection opening 150 and the discharge opening 157, the respective pressure drop over each of the openings 150, 157 is considerably reduced as compared to a configuration where the entire pressure difference is relieved only through one opening. Distributing the relief of the pressure difference to the connection opening 150 and the discharge opening 157 thus has the advantage that excessively high fluid velocities through the openings 150 and 157 can be avoided and the risk of cavitation can be at least reduced, if not completely avoided.

Furthermore, since both the connection opening 150 and the discharge opening 157 can be used to adjust the recirculation flow, e.g. by changing the diameter or the shape of the connection opening 150 or the discharge opening 157 an even more precise and simpler adjusting of the discharge flow becomes possible.

In addition, the configuration and the arrangement of the discharge opening 157 can be used to improve or to optimize the suction performance of the centrifugal pump 1. The discharge opening 157 can be configured to supply the fluid to the suction chamber 31 with an entrance angle α (FIG. 4) relative to a main flow direction D of the fluid in the suction chamber 31, wherein the entrance angle α is different from zero degree. In FIG. 4 the dashed arrow D indicates the main flow direction D of the fluid in the suction chamber 31, and the arrow R indicates the main direction, in which the recirculation flow is discharged from the discharge opening 157 and inserted into the suction chamber 31. Preferably and as it is shown in FIG. 4, both the main flow direction D and the main direction R of the recirculation flow are perpendicular to the axial direction A.

By the entrance angle α the suction performance of the centrifugal pump 1 can be improved. Practical experience has shown, that in many applications an entrance angle of zero degree is not optimal, in particular when the main direction R of the recirculation flow is perpendicular to the axial direction A.

Therefore, in particular when the main direction R of the recirculation flow is perpendicular to the axial direction A, it is preferred that the entrance angle α is between 45° and 315°. Specifically, the entrance angle α can be approximately 90° or 270° or 180°. When the entrance angle α is 180° the main direction R of the recirculation flow discharged through the discharge opening 157 is opposite to the main flow direction of the fluid in the suction chamber 31.

In other embodiments the main direction R of the recirculation flow can alternatively or additionally include an angle with the axial direction A which is different from 90°.

Figure 4:
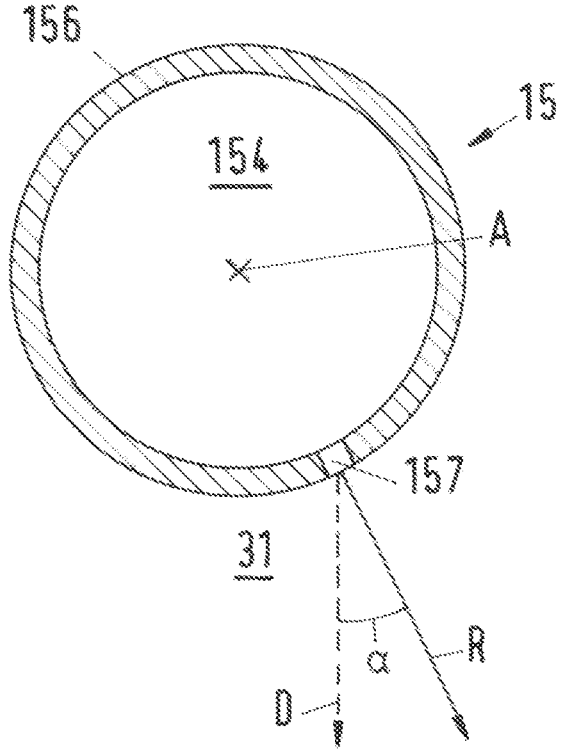
FIG. 4 illustrates the flow control rod of FIG. 3 in a cross-sectional view along the cutting line IV-IV in FIG. 3.
Figure 5:
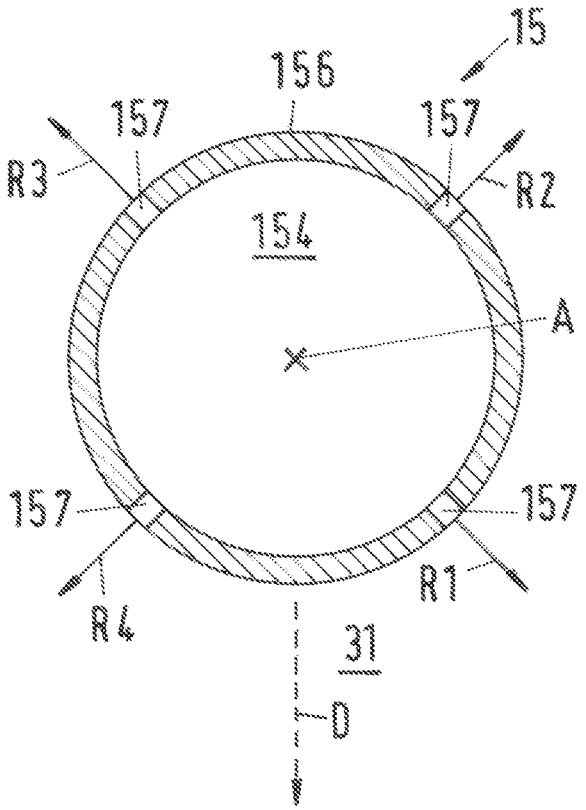
FIG. 5 illustrates the same as FIG. 4, but for a variant of the flow control pin.

FIG. 5 shows a variant of the flow control pin 15 in a representation corresponding to the representation in FIG. 4. In the following explanation only the differences of said variant as compared to the embodiment shown in FIG. 4 will be described in more detail. All the other explanations hereinbefore are also valid for this variant in the same manner or in an analogous manner.

According to the variant shown in FIG. 5 the second internal chamber 154 comprises a plurality of discharge opening 157, for example four discharge openings 157, which are distributed along the circumference of the outer wall 156 of the flow control rod 15. Preferably the discharge openings 157 are equidistantly distributed along the circumference of the outer wall 156 of the flow control rod 15.

For each discharge opening 157 there is a main direction, in which the recirculation flow is discharged from the respective discharge opening 157 into the suction chamber 31. These main directions are indicated by arrows R1, R2, R3 and R4 in FIG. 5. Each main direction R1, R2, R3, R4 is preferably, however not necessarily, perpendicular to the axial direction A. Furthermore, it is preferred that none of the main directions R1, R2, R3, R4 coincides with the main flow direction D of the fluid in the suction chamber 31, i.e. each of the main directions R1, R2, R3, R4 includes an entrance angle with the main flow direction D, which is different from zero.

It shall be understood that the number of four discharge openings 157 is exemplary. In other embodiments the second internal chamber 154 can include more or less than four discharge openings 157. If the number of discharge openings 157 is even, it is preferred that the discharge openings 157 are arranged pairwise diametrically opposed.

What is claimed is:

1. A multistage centrifugal pump for conveying a fluid, comprising:

a pump housing with an inlet to receive the fluid and an outlet to discharge the fluid;

a first stage impeller and a last stage impeller configured to convey the fluid from the inlet along a flow path to the outlet;

a shaft configured to rotate the first stage impeller and the last stage impeller about an axial direction;

a suction chamber arranged upstream of the first stage impeller and in fluid communication with the inlet;

a recirculation path for the fluid comprising a return opening and extending from the return opening to the suction chamber, the return opening located at or in the flow path downstream of the first stage impeller and upstream of the last stage impeller; and a flow control rod disposed in the recirculation path, the flow control rod configured to adjust a recirculation flow through the recirculation path into the suction chamber and configured and arranged to be removable from and insertable into the recirculation path from an outside of the centrifugal pump.

2. The multistage centrifugal pump in accordance with claim 1, further comprising a second stage impeller, and the return opening is located at or in the flow path downstream of the first stage impeller and upstream of the second stage impeller.

3. The multistage centrifugal pump in accordance with claim 1, wherein the pump is a between-bearing pump.

4. The multistage centrifugal pump in accordance with claim 1, comprising an outer barrel casing, in which the pump housing is arranged.

5. The multistage centrifugal pump in accordance with claim 1, wherein the return opening is one of a plurality of return openings in the recirculation path, and the recirculation path comprises an annular intermediate chamber, and a return passage, each return opening in the plurality of return openings is in fluid communication with the intermediate chamber and the return passage connects the intermediate chamber with the suction chamber.

6. The multistage centrifugal pump in accordance with claim 5, wherein the flow control rod extends from a first end to a second end and comprises a first internal chamber and a second internal chamber with the first and the second internal chambers delimited by an outer wall of the flow control rod, the first internal chamber is located at the first end and open at the first end, the second internal chamber is located at the second end and comprises a discharge opening to discharge fluid from the second internal chamber into the suction chamber, the first internal chamber and the second internal chamber are separated from each other by a partition wall and the flow control rod is configured such that the outer wall sealingly fits into the recirculation path at a location between return opening and the suction chamber.

7. The multistage centrifugal pump in accordance with claim 6, wherein the flow control rod is configured to sealingly fit into the return passage with the first end facing the intermediate chamber.

8. The multistage centrifugal pump in accordance with claim 6, wherein in a new condition of the flow control rod, the partition wall is closed so as to prevent flow of the fluid from the first internal chamber to the second internal chamber, and the flow control rod is configured to close the recirculation path to prevent the fluid from passing through the recirculation path into the suction chamber.

9. The multistage centrifugal pump in accordance with claim 6, wherein the partition wall includes a connection opening to enable flow of the fluid from the first internal chamber into the second internal chamber.

10. The multistage centrifugal pump in accordance with claim 6, wherein the discharge opening is one of a plurality of discharge openings distributed along a circumference of the outer wall of the flow control rod.

11. The multistage pump in accordance with claim 10, wherein the plurality of discharge openings are equidistantly distributed along the circumference of the outer wall of the flow control rod.

12. The multistage centrifugal pump in accordance with claim 6, wherein the discharge opening is a bore in the outer wall of the flow control rod extending from the second internal chamber through the outer wall of the flow control rod to allow the fluid to flow from the second internal chamber to the suction chamber.

13. The multistage centrifugal pump in accordance with claim 12, wherein the discharge opening is configured to supply the fluid to the suction chamber with an entrance angle relative to a main flow direction of the fluid in the suction chamber, the entrance angle being different from zero degree.

14. The multistage centrifugal pump in accordance with claim 13, wherein the entrance angle is between 45° and 315°.

* * * * *